US006595354B1

(12) United States Patent
Scicluna

(10) Patent No.: US 6,595,354 B1
(45) **Date of Patent: *Jul. 22, 2003**

(54) LUGGAGE WITH LOW-PROFILE HANGER BRACKET

(75) Inventor: Paul Scicluna, Penndel, PA (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/115,386

(22) Filed: Apr. 3, 2002

(51) Int. Cl.[7] ..... A45C 5/12; A45C 13/00

(52) U.S. Cl. ..... 206/279; 206/289; 206/291

(58) Field of Search ..... 206/279, 287.1, 206/289, 291, 292; 248/304, 316.7; 211/124

(56) References Cited

U.S. PATENT DOCUMENTS

| | | | | | |
|---|---|---|---|---|---|
| 928,006 | A | * | 7/1909 | Thomas | 248/304 X |
| 1,743,838 | A | * | 1/1930 | Walinsky | 206/289 |
| 1,789,164 | A | * | 1/1931 | Victorsohn | 248/304 X |
| 4,925,021 | A | * | 5/1990 | Pulichino, Jr. | 206/279 |
| 4,932,625 | A | * | 6/1990 | Hotchkiss, Jr. | 248/316.7 |
| 5,474,162 | A | * | 12/1995 | Shyr et al. | 206/289 X |
| 5,507,460 | A | * | 4/1996 | Schneider | 248/304 X |
| 5,515,981 | A | * | 5/1996 | Gregory et al. | 211/89 X |
| 5,575,391 | A | * | 11/1996 | Gerch | 206/279 X |
| 5,628,398 | A | * | 5/1997 | Jackson | 206/289 X |
| 5,769,294 | A | * | 6/1998 | Heinz et al. | 248/304 X |
| 6,059,078 | A | | 5/2000 | Nykoluk | 190/103 |
| 6,092,779 | A | * | 7/2000 | Depew et al. | 248/304 X |
| 6,220,411 | B1 | | 4/2001 | Scicluna et al. | 190/103 |
| 6,305,513 | B1 | * | 10/2001 | Lu | 190/103 |

FOREIGN PATENT DOCUMENTS

| | | | |
|---|---|---|---|
| EP | 144653 | * | 6/1985 |

* cited by examiner

*Primary Examiner*—Sue A. Weaver
(74) *Attorney, Agent, or Firm*—Baker Botts LLP

(57) ABSTRACT

An item of expandable luggage includes a multiple expansion capability, including an expandable main compartment and an expandable external pocket. The luggage item also includes a pair of internal tie-down panels for better holding of clothes within the item and for providing additional storage pockets. A low-profile clothes hanger bracket is provided which is useful with either wire or wooden clothes hangers.

7 Claims, 2 Drawing Sheets

LUGGAGE WITH LOW-PROFILE HANGER BRACKET

BACKGROUND OF INVENTION

1. Field of the Invention

The present invention relates to luggage, especially travel luggage, and in particular to luggage having a low-profile clothes hanger bracket capable of holding wire or wooden (suit) hangers.

2. The Related Art

It is well known in luggage items to provide brackets of various designs for holding clothes carried on hangers, e.g., suits or dresses. Such prior art brackets, however, have not been entirely satisfactory, particularly for small, lightweight towable or carry-on bags. The prior brackets have tended to be overly large and obtrusive, or to be incompatible with certain types of commonly used hangers, e.g. wooden suit hangers, or even to require the use of specially designed hangers. It is frequently necessary with prior art brackets, for example, for clothing to be transferred from the conventional hangers used in closets to other or special hangers in order to hang in the luggage item.

Accordingly, a need exists for a lightweight, compact versatile clothes hanger bracket for luggage items that overcomes the foregoing disadvantages of the prior art.

BRIEF SUMMARY OF THE INVENTION

An object of the present invention is to provide a low-profile clothes hanger bracket for a luggage item, which bracket is useful with both commonly available wire or wooden hangers, so as to allow clothing to be packed directly from the closet, i.e., without transfer to another hanger.

These and other objects of the invention are attained by the provision of a hanger bracket having a base member secured to a wall panel or member of a luggage item and including at least one, and preferably two, hook members. The hook(s) member extends generally perpendicularly from the base member, then curves to extend along the base member in spaced relation thereto, and terminates in a free end. The spacing between the base member and the opposed portion of the hook member is preferably such that only a single clothes hanger, i.e., the hook portion of the coat hanger, will fit between the hook and the base member. This advantageously provides a low, flat profile for the clothes hanger bracket. On the other hand, the length of the second hook portion in the direction along the base member may be sufficient to hold two or more clothes hangers in stacked relation.

A resilient detent member may be provided on the base member to cooperate with the opposed hook portion to capture a coat hanger in the bracket. The free end of each hook portion preferably flares away from the base member to facilitate entry of a clothes hanger into the space between the second hook portion and the base member.

For economy and ease of manufacture, the clothes hanger bracket is preferably a one-piece molded plastic component.

DESCRIPTION OF THE DRAWINGS

For a more complete understanding of the present invention, and the advantages thereof, reference may be made to the following written description of an exemplary embodiment, taken in conjunction with the accompanying drawings, in which.

DESCRIPTION OF AN EXEMPLARY EMBODIMENT

Figure 1:
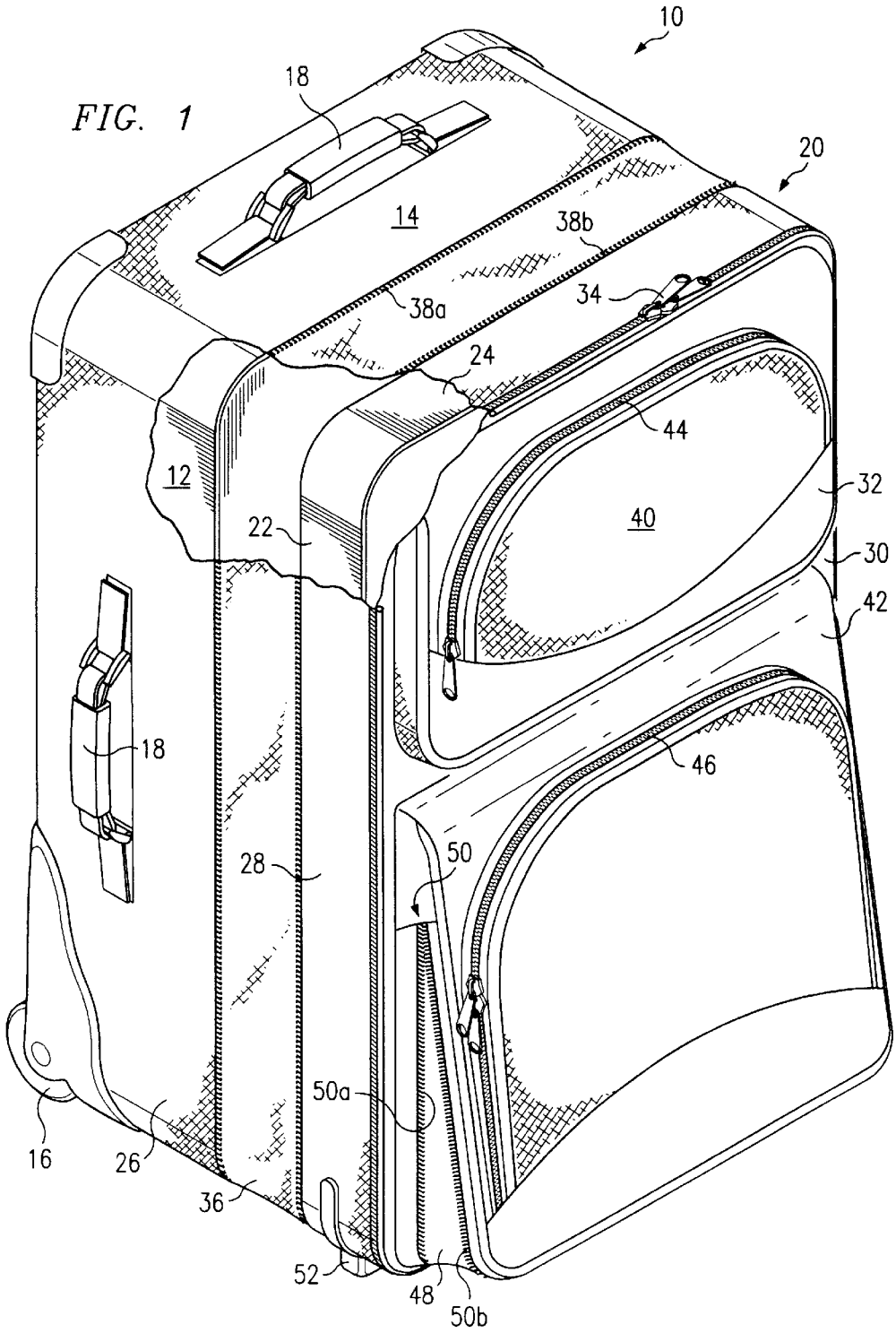
FIG. 1 is a generally schematic three-quarter front pictorial view of a luggage item, with portions broken away.

The luggage item shown in FIG. 1 has a two-component frame, which may be of any suitable specific construction in terms of materials, manner of assembly, and configurations of the parts. A main frame component 10 has a pair of opposite rectangular planar side wall panels 12 (only one of which is shown) and a pair of opposite wall members 14 (only one of which is shown), which are substantially rigid and rigidly connected at the corners. The opposite wall members are also referred to herein as top and bottom members, which is their normal orientation when the luggage item is in use. Although the drawing shows the member 14 as a panel, most travel luggage being marketed currently is of the towable, wheeled type. In practice for such luggage items, the bottom member and top member of the main frame are configured to accept wheels 16, a towing handle (not shown), one or more carrying handles 18, and the like. The main frame component 10 may also have a partial or complete rigid back wall panel. A secondary frame component 20 is formed of opposite rectangular planar panels 22 and top and bottom members 24, which as a practical matter will usually also be rectangular planar panels of sheet material.

The main frame component 10 receives a cover 26 of a durable fabric. The sides, top and bottom of the secondary frame receive a fabric cover 28. Access to the interior of the luggage item is through a front opening that is closed by a panel 30, is joined to the cover 28 at the side edge 32 and can be opened and closed by undoing and doing up a zipper 34 along three sides.

The main part (main frame 10 and its cover 26) of the luggage item is joined to the secondary part (secondary frame 20 and its cover 28, 30) by a gusset 36 of a durable, flexible material that extends around the entire perimeter of the luggage item (along the top, bottom and both side walls). In the expanded state of the item, the gusset 36 peripherally bounds that part of the entire volume of the main compartment by which the volume of the item is increased upon movement of the secondary unit away from the main unit. In the retracted (smaller volume) state (not shown) of the luggage item, a zipper having mating halves 38*a*, 38*b* on the adjacent ends of the main frame component 10 and the secondary frame 20, and which extends about the entire perimeter of the item, is done up. The gusset 36 folds into the interior of the item in the retracted state of the item.

As disclosed in the commonly-owned U.S. Pat. No. 6,220,411 B1, the main frame component 10 may be joined to the secondary frame component 20 by two identical bridge assemblies (not shown), one of which is associated with the side panels 12 and 22 and the other with the opposite side members (not shown). The bridge assemblies stabilize the shape of the luggage item by preventing up and down movements, side to side movements, rotational skewing movements, and side to side and front to back cocking movements of the secondary unit relative to the main unit. Such bridge assemblies may be incorporated into the embodiment of FIG. 1 if desired. Alternatively, they may be omitted, particularly in luggage items in which the enhanced stability provided by the bridge assemblies is not required.

As shown in FIG. 1, one or more external pockets 40, 42 are provided on the front side of the front panel 30. Zippers 44, 46 may be provided for opening and closing the pockets.

The lower pocket 42 includes in its bottom and side walls a second gusset 48 of flexible material, suitably of the same type as used for the first gusset 36. The edges of the pocket 42 adjoining the gusset 48 carry the mating halves 50*a*, 50*b* of a zipper 50 that extends peripherally over the full length of the gusset 48. As will be appreciated, the front pocket 42 is in a retracted state when the zipper 50 is done up, and in an expanded state when the zipper 50 is undone. Thus, a second stage of expandability is provided in the luggage item, which affords still greater flexibility in adapting the items to the requirements of different itineraries.

Although shown in FIG. 1 as extending only on three sides of the front pocket 42, the gusset 48 could extend continuously around the entire periphery of the front pocket, like the first gusset 36. Also, if desired, an expansion gusset could be incorporated into the front pocket 40, to provide still more added storage space.

The above-described multiple expansion feature is the subject of applicant's copending U.S. application Ser. No. 10/115,402 filed concurrently herewith and entitled "Multiple Expansion Luggage Item."

For enhanced stability of the luggage item, particularly in the expanded state, the front legs 52 of the item are mounted on the lower wall of the second frame component 20. Thus, when the main compartment is extended, the front legs 52 move forward with the second frame component.

Figure 2:
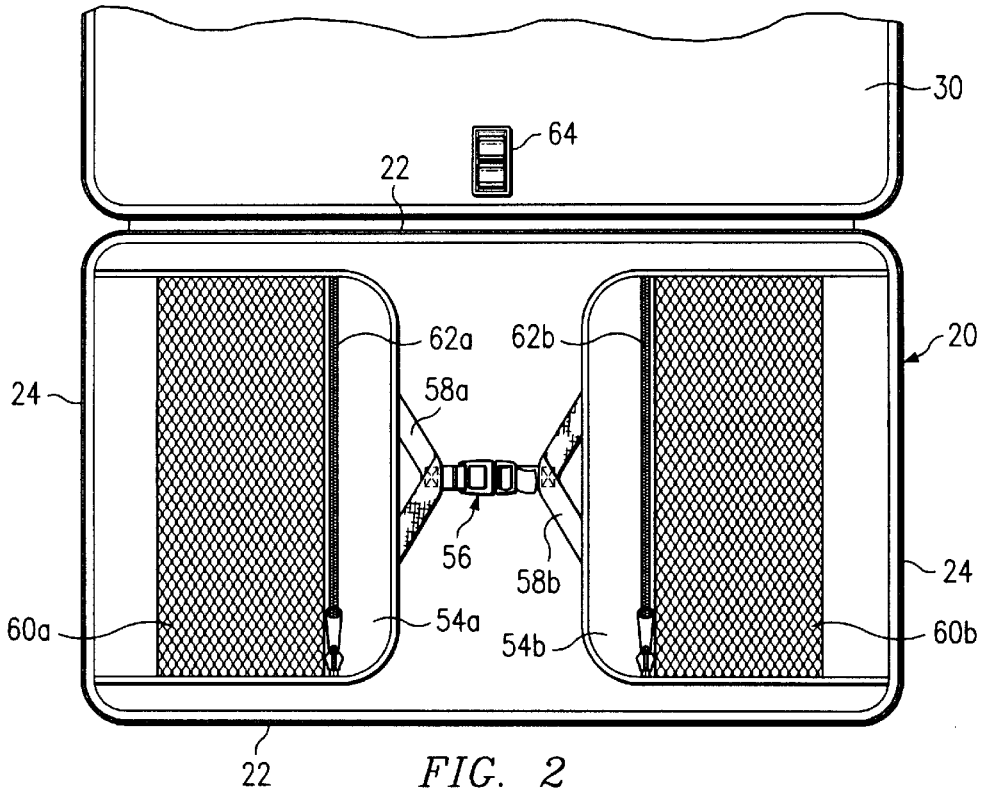
FIG. 2 is a front view of the luggage item, with the front panel opened and folded back.

FIG. 2 depicts a simplified front view of the luggage item with the front panel 30 folded open. A pair of tie-down panels 54*a*, 54*b* are attached to respective ones of the opposite wall members 24 of the second frame component 20. The tie-down panels 54*a*, 54*b* serve the dual function of better holding clothes in place (than do the narrow tie-down straps conventionally used) and of also providing convenient storage for last-minute items, or the like.

The panels 54*a*, 54*b*, therefore, extend over at least half, and preferably nearly all, of the distance between the opposite wall panels 22 of the second frame component and at least one-quarter, and preferably at least one-third, of the distance between the opposite wall members 24. The panels 54*a*, 54*b* are releasably attached to one another by a quick-release buckle 56 (or other conventional connecting tie or mechanism), whose mating halves are connected to the individual panels in any suitable way, e.g., by straps 58*a*, 58*b* that are attached to the facing ends of the panels at spaced points along their width. The relatively broad extent of the tie-down panels 54*a*, 54*b* ensures that clothing will be securely held in place during transit.

Also, at least one, and preferably both, of the panels 54*a*, 54*b* incorporates a pocket 60*a*, 60*b* for convenient additional storage. Zippers 62*a*, 62*b*, may be provided for greater security. For convenience, the upper or front side(s) of the pocket or pockets 62*a*, 62*b* is preferably formed of a see-through mesh for convenience of viewing the articles stored in the pocket(s).

The panels 54*a*, 54*b* are preferably connected to the second frame component 20, so that, when the luggage item is expanded, the panels move along with the frame 20 to overlie the expanded volume of the main compartment.

As noted above, the tie-down panels 54*a*, 54*b* may, if desired, be provided in a non-expandable luggage item. In that case, the panels 54*a*, 54*b* could be connected to stationary frame members of the item, corresponding, for example, to the opposite wall members 24 of FIG. 1.

The above-described dual-function tie-down panel feature is the subject of applicant's copending U.S. patent application Ser. No. 10/115,385 filed concurrently herewith and entitled "Luggage With Tie-Down Pockets".

Figure 3:
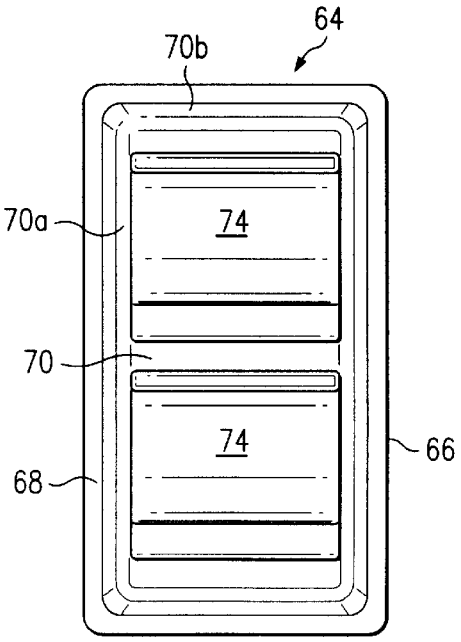
FIG. 3 is a plan view of one embodiment of a clothes hanger bracket according to the invention.

As shown in FIG. 2, in accordance with the invention a clothes hanger bracket 64 is mounted on the rear side of the front panel 30 near the side thereof connected to the second frame component wall panel 22. The structure of the bracket 64 is shown in more detail in FIGS. 3 and 4.

The bracket 64, which is preferably formed as a single-piece plastic component, includes a rectangular base member 66 having a peripheral border region 68 and a raised central region 70. The edges 70*a*, 70*b* of the central region are preferably beveled. The bracket 64 may be secured to the front panel 30 in any suitable manner, e.g., by stitching through the peripheral region 68.

Figure 4:
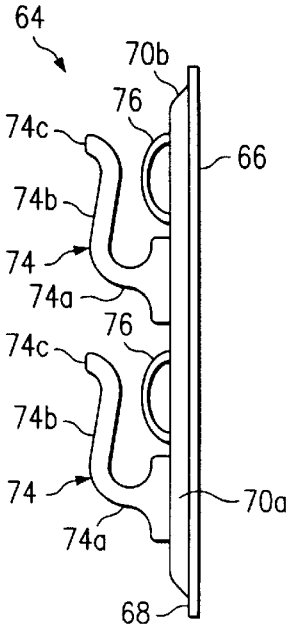
FIG. 4 is side view of the clothes hanger bracket of FIG. 3.

At least one, and preferably two, clothes hanger hooks 74 are carried by the central region 70 of the base member 66. As best shown in FIG. 4, each hook 74 includes a first portion 74*a* that extends generally perpendicular to the base member 66, then curves into a second portion 74*b* that extends along the base member in spaced relation thereto, and then curves away from the base member to terminate in a free end 74*c*.

The spacing between the second portion 74*b* and the base member is preferably only slightly greater than the thickness of the hook of a single clothes hanger. This gives the bracket 64 an advantageous, space-saving low profile in cross section. A resilient detent member 76 is provided on the base member in opposed relation to the second hook portion 74*b*. The detent 76 and the opposed hook portion 74*b* are adapted together to capture a clothes hanger hook therebetween. To that end, the second portion 74*b* may be inclined slightly towards the base member 66.

The length of the hook portion 74*b* along the base member is preferably sufficient to accommodate two or more clothes hangars stacked on one another in the lengthwise direction of the second portion 74*b*. The free end 74*c* of each hook 74 curves away from the base member to facilitate entry of the hook end of a clothes hanger into the space between the second hook portion 74*b* and the base member 66. The bracket is useful with either wire or wooden hangers, thereby allowing clothing, e.g. dresses or suits, to be packed directly from the closet.

In the luggage item shown in FIGS. 1 and 2, the bracket 64 is advantageously located as shown in FIG. 2, where it would be adjacent a fold-out suiter section (not shown). The bracket may alternatively be located in other positions within a luggage item, depending upon the size and configuration of the item. In accordance with the invention, the bracket 64 has utility in luggage items independently of the expandability and tie-down panel features described above.

Although the invention has been described and illustrated herein by reference to specific embodiments thereof, it will be understood that such embodiments are susceptible of modification and variation without departing from the inventive concepts disclosed. All such modifications and variations, therefore, are intended to be encompassed within the spirit and scope of the appended claims.

What is claimed is:

1. In a luggage item including a clothes hanger bracket for holding at least one clothes hanger, the clothes hanger bracket being attached to a panel of the luggage item, the improvement in said clothes hanger bracket comprising:

a base member;

the base member having a substantially flat peripheral border region and a raised central region;

at least one hook member on the raised central region extending in a first portion generally perpendicularly to the base member, then curving to extend in a second portion along, but spaced from, the base member, and terminating in a free end spaced from the base member; and the base member being attached to the panel of the luggage item by stitching through the peripheral border region thereof.

2. The item of luggage as claimed in claim 1, wherein the length of the first portion of each hook member is such that the spacing between the second hook member portion and the base member is only slightly greater than the thickness of the hook end of a single clothes hanger, whereby the clothes hanger bracket has a low profile as viewed in cross section.

3. The item of luggage as claimed in claim 2, wherein the clothes hanger bracket further comprises a resilient detent member carried by the central region of the base member opposite the second portion of the at least one hook member, the resilient detent member being curved outwardly from the base member towards the hook member second portion such that the resilient detent member and the hook member second portion are operative to capture the hook end of a clothes hanger therebetween.

4. The item of luggage as claimed in claim 3, wherein the clothes hanger bracket is a one-piece plastic component.

5. The item of luggage as claimed in claim 4, wherein the clothes hanger bracket comprises an identical pair of said hook members.

6. The item of luggage as claimed in claim 4, wherein the length of the second portion of the at least one hook member is sufficient to receive two or more coat hanger hook ends, stacked one on another in the lengthwise direction of the second portion, in the space between the second hook member portion and the base member.

7. The item of luggage as claimed in claim 1, wherein the second hook member portion is slightly inclined from the first hook member portion towards the base member and is curved at its free end away from the base member to facilitate entry of the hook end of a clothes hanger into the space between the second hook member portion and the base member.

* * * * *